US008168878B2

(12) United States Patent
Simon

(10) Patent No.: US 8,168,878 B2
(45) Date of Patent: May 1, 2012

(54) SYSTEM FOR COORDINATING A PERFORMANCE

(76) Inventor: Jerome E. Simon, Las Vegas, NV (US)

( * ) Notice: Subject to any disclaimer, the term of this patent is extended or adjusted under 35 U.S.C. 154(b) by 0 days.

(21) Appl. No.: 12/636,488

(22) Filed: Dec. 11, 2009

(65) Prior Publication Data

US 2010/0162881 A1 Jul. 1, 2010

Related U.S. Application Data

(60) Provisional application No. 61/203,813, filed on Dec. 30, 2008.

(51) Int. Cl.
*G10H 7/00* (2006.01)

(52) U.S. Cl. ..... 84/645; 84/477 R

(58) Field of Classification Search ..... 84/645, 84/600, 464 R, 464 A, 477 R, 485 R
See application file for complete search history.

(56) References Cited

U.S. PATENT DOCUMENTS

| | | | | |
|---|---|---|---|---|
| 3,827,330 | A | 8/1974 | Ward | |
| 6,315,571 | B1 | 11/2001 | Lee | |
| 6,969,795 | B2 * | 11/2005 | Hofmeister et al. | 84/600 |
| 7,268,290 | B2 | 9/2007 | Parsons et al. | |
| 7,563,972 | B2 * | 7/2009 | Kubitz et al. | 84/600 |
| 2006/0123978 | A1 | 6/2006 | Kubitz et al. | |
| 2007/0261533 | A1 | 11/2007 | Marshall | |
| 2008/0127810 | A1 | 6/2008 | Egan | |

* cited by examiner

*Primary Examiner* — Jeffrey Donels
(74) *Attorney, Agent, or Firm* — Dickstein Shapiro LLP

(57) ABSTRACT

Embodiments described herein provide a musical performance system that produces a set of signals or cues to individual members of a choir or group of musical instruments as to when each member is to play their particular instrument. Typically, the musical instrument is comprised of a handbell as used in bell choirs. The system alerts, e.g., via vibration or light, children or physically challenged individuals at a predetermined, specified time such that they may perform music with the correct rhythm and timing. The system comprises a computer readable medium for storing data, a musical instrument digital interface unit, a sequencer, a sending unit, and at least one receiving unit.

22 Claims, 11 Drawing Sheets

100

| A | B | C | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| C# | 16 | d | | | | | | | | | | | | | | | | | | | | | | | | | | | | | | | | | | | | | | | | | | C# |
| C | 15 | c | | | | | | | | | | | | | | | | | | | | | | | | | | | | | | | | | | | | | | | | | | C |
| B | 14 | b | | | | | | | | | | | | | | | | | x | | | | | x | | x | | | | | | | | | x | | x | | x | | | | | B |
| B-flat | 13 | a | | | | | | | | | x | | | | | | | | | | | | | | x | | x | | | | | | | | | | | | | | | | | B-flat |
| A | 12 | g | x | | | | | | | | | | | | | x | | x | x | | | | | | | | | | | | | | | | x | | x | | x | | x | | x | A |
| G# | 11 | f | | | | | | | | | x | | | | | | x | | | | | | | | | | x | | | | | | | | | | | | | | | | | G# |
| G | 10 | e | x | | | | | x | | x | | | | | | | | | | | | | | | | | | | | | | | | | | | | | | | x | | x | G |
| F# | 9 | d | | | | | | | x | | x | | | | | | | | x | | | | | | | | | | | | | | | | x | | x | | x | | | | | F# |
| F# | 8 | c | x | | | | | | | | | | | | | | | | | | | | | | | | x | | | | | | | | | | | | | | x | | x | F# |
| E | 7 | b | | | | | | | | | | | | | | | | | x | | | | | | | | | | | | | | | | x | | x | | x | | | | | E |
| D# | 6 | a | | | | | | | | | x | | | | | | | | | | | | | | | | x | | | | x | | | | | | | | | | | | | D# |
| D | 5 | g | x | | | | | | | | | | | | | | | | x | | | | x | | | | | | | x | | | | | x | | x | | | | x | | x | D |
| C# | 4 | f | | | | | | | | | x | | | | x | | | | | | | x | | | | | x | | x | | | | | | | | | | | | | | C# |
| C | 3 | e | x | | | | x | | | | | | | x | | | | | x | | x | | | | | | | | | | | | | | | | | | | x | | x | C |
| B | 2 | d | | | | x | | | | | x | | x | | | | | | | | | | | | | | | | | | | | | | x | | | | | | | | | B |
| B-flat | 1 | c | x | | x | | | | | | | | | | | | | | | | | | | | | | | | | | | | | | | | | | | | x | | x | B-flat |
| | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | |

FIGURE 2

SYSTEM FOR COORDINATING A PERFORMANCE

CROSS REFERENCE TO RELATED APPLICATIONS

This application claims priority from U.S. Provisional Application No. 61/203,813, filed on Dec. 30, 2008, which is hereby incorporated by reference in its entirety.

FIELD OF THE INVENTION

Embodiments of the invention relate to the field of music education devices and the performance of music by a group using musical instruments. In particular, the embodiments relate to a system allowing children or physically challenged persons to perform in concert by signaling the individual members of the group when they are to play their instrument.

BACKGROUND OF THE INVENTION

Handbell choirs have been around for many years and have performed in churches, schools and other settings. Handbell music typically sounds quite beautiful, however, the music can be significantly affected by the coordination of the sounds produced by the individual bell choir members.

In a typical handbell choir, each individual in the choir holds in their hand one or two bells. Each bell in the choir rings a single note unique from the notes of all the other bells in the choir. A musical piece is performed by choir members ringing a coordinated succession of musical notes that correspond with the notes of the song being performed. Proper coordination of the ringing of various bells by handbell choir members is a challenge for any handbell choir. This coordination can be done by preprogramming. Preprogramming is the process by which individual choir members memorize the sequence of bell-ringing for a particular musical piece. The disadvantage to preprogramming is that it requires a significant amount of memorization and practice for each handbell choir member to ready themselves for even a simple musical performance.

As an alternative to preprogramming, each choir member could read a musical score, and from the musical score take cues as to when particular notes are to be sounded. The advantage of such music-reading is that it lessens the amount of practice necessary for the handbell choir members to ready themselves for a musical performance. The disadvantage to such music-reading is that it requires each choir member to be able to read music, a skill which most members of the general public, as well as many musicians do not have. Such disadvantages are especially pronounced when the handbell choir members are children or even the physically challenged.

Children tend to have shorter attention-spans than adults and thus are less likely to memorize bell-ringing sequences or to spend the time required learning to read music. The physically challenge have difficulty either reading music because they are vision impaired, or tone challenged because they are hearing impaired.

Groups of musicians and artists have been performing in concert for many years. Traditionally, musicians are lead by conductors who coordinate the performance. To do this, the conductor controls the musicians by commanding them to play according to the timing and rhythm of the music. There are many benefits to participating in such performances. Benefits include self-esteem building, group cohesion, team-building (how to cooperate with others), hand-eye coordination, gross motor skill development, right-left laterality, competency, social development, and many others.

Historically, the prerequisites for bell choir members were limited to members of the population who had vision, hearing, and memory abilities. Accordingly, there is a need for a system that allows children or physically challenged individuals to perform in concert as a coordinated group. More specifically what is needed is a more individualized system of alert signals, such as a system for signaling individualized handbell choir members when each one is to ring their specific bell. The system should also not interfere or detract from the visual appearance of a choir on a stage or other performance setting.

This system enables people with no formal music training or ability to perform in concert. The system is comprised of two parts, each part having many components. Part one is the central remote control unit which utilizes musical data to send wireless rhythmic signals to bell choirs. Part two is made up of multiple receiving units which receive the wireless rhythmic signals and prompt users to play their instruments. The receiving units can receive the signal and ring out reproduced digital sounds of various musical instruments.

Recent progress in the miniaturization of electronics has made it possible to produce lightweight receiving units, comparable to the size of a cell phone. Cell phones and similar electronic devices are user-friendly and are saturated throughout society. In addition, the use of cell phones in vibrate mode has made the system's quick training a familiar experience for virtually all segments of the population. If a person has held a cell phone, they can perform music with this system.

BRIEF DESCRIPTION OF THE DRAWINGS

FIG. 2 illustrates a music worksheet used in accordance with an embodiment described herein.

DETAILED DESCRIPTION OF THE INVENTION

In the following detailed description, reference is made to certain embodiments of the invention. These embodiments are described with sufficient detail to enable those skilled in the art to practice them. It is to be understood that other embodiments may be employed, and that various structural, logical, and electrical changes may be made.

Embodiments described herein provide a musical performance system that produces a set of signals or cues to individual members of a choir or group of musical instruments as to when each member is to play their particular instrument.

Preferably, the musical instrument is comprised of a handbell as used in bell choirs. The system, e.g., via vibration or light, alerts children or physically challenged individuals to play their respective instrument at a predetermined, specified time such that when played they perform music with the correct rhythm and timing. Referring to FIGS. 1-9, embodiments are described with reference to the system, where like reference numbers are used consistently for like features throughout the drawings. It should be appreciated that the embodiments described herein are exemplary and can be utilized for many different types of performances including, but not limited to, music and dance recitals.

Figure 1:
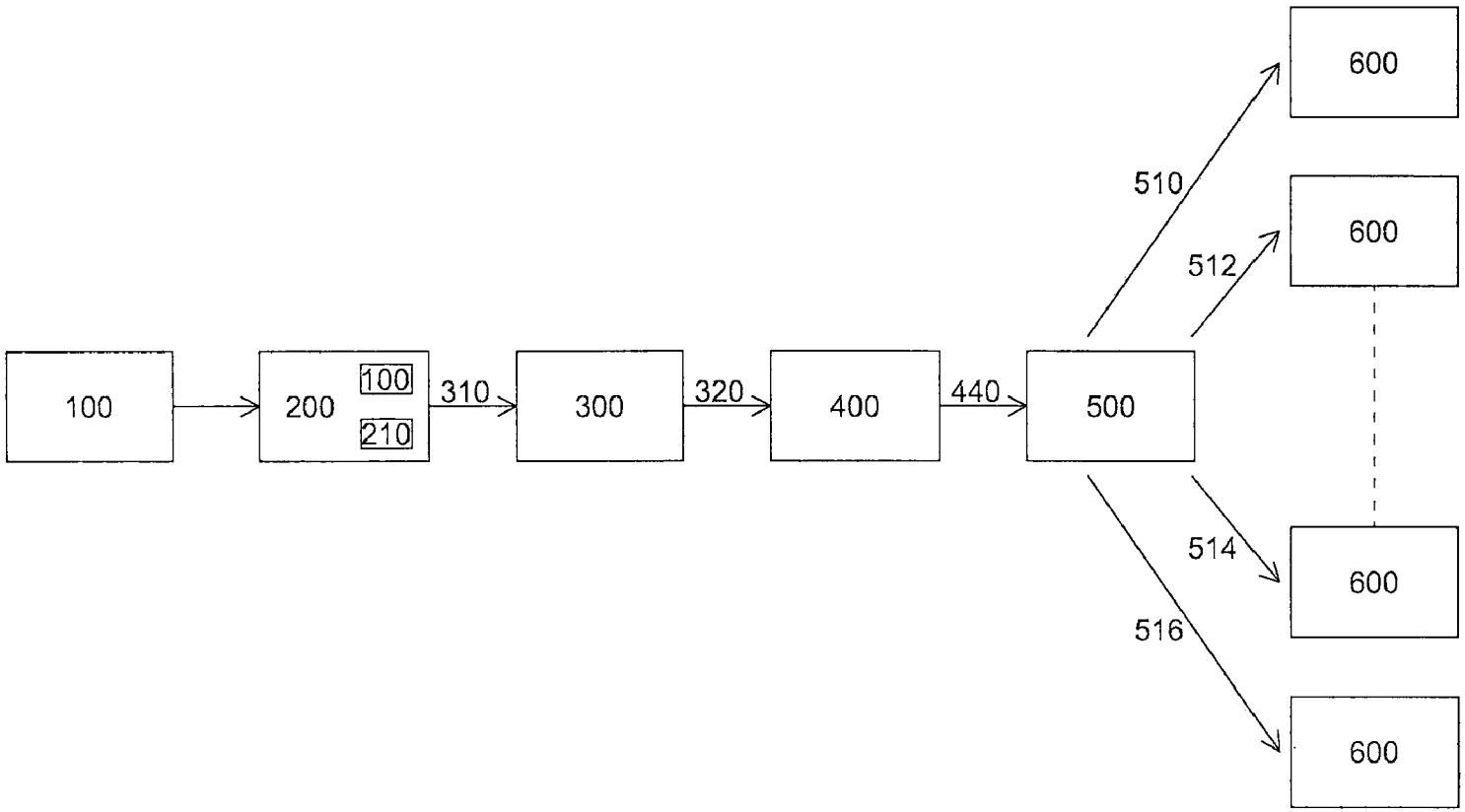
FIG. 1 illustrates a flow-chart view of a musical performance system in accordance with an embodiment described herein.
Figure 3:
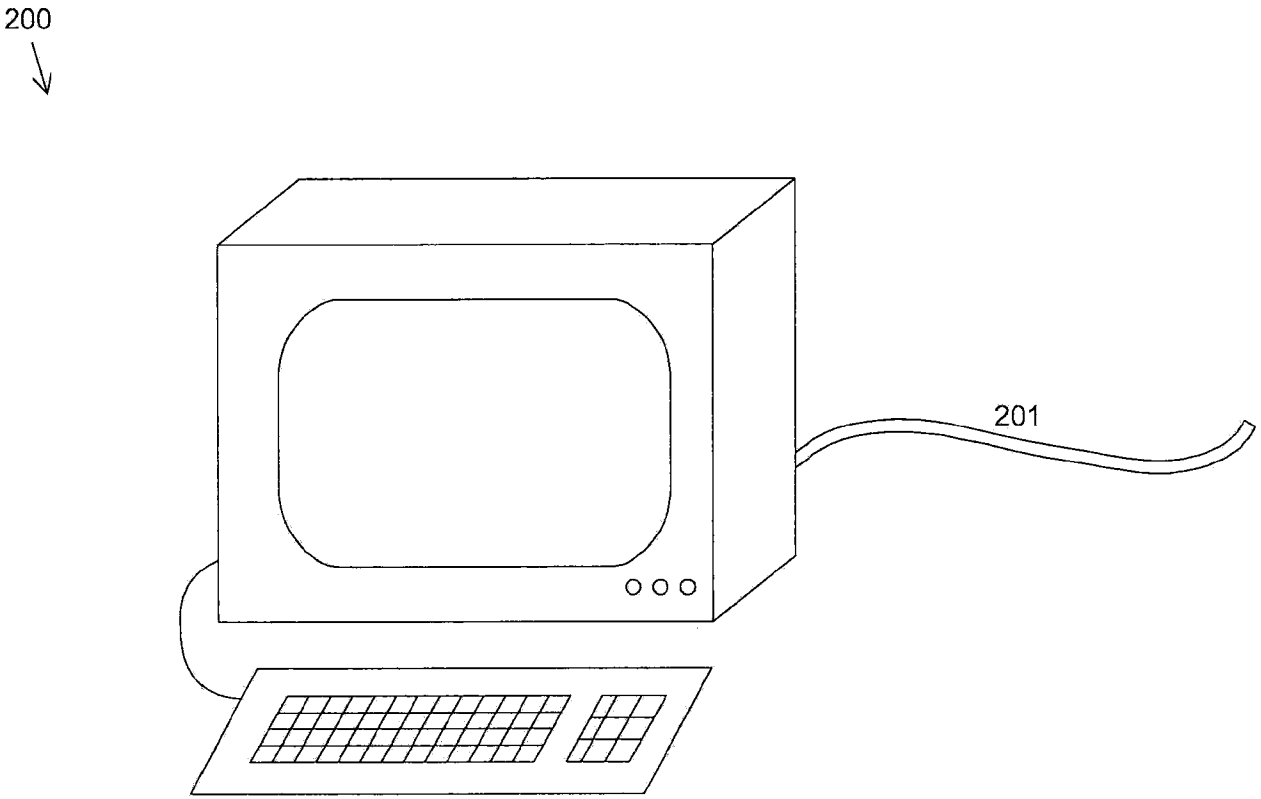
FIG. 3 illustrates a computer used in accordance with an embodiment described herein.
Figure 4:
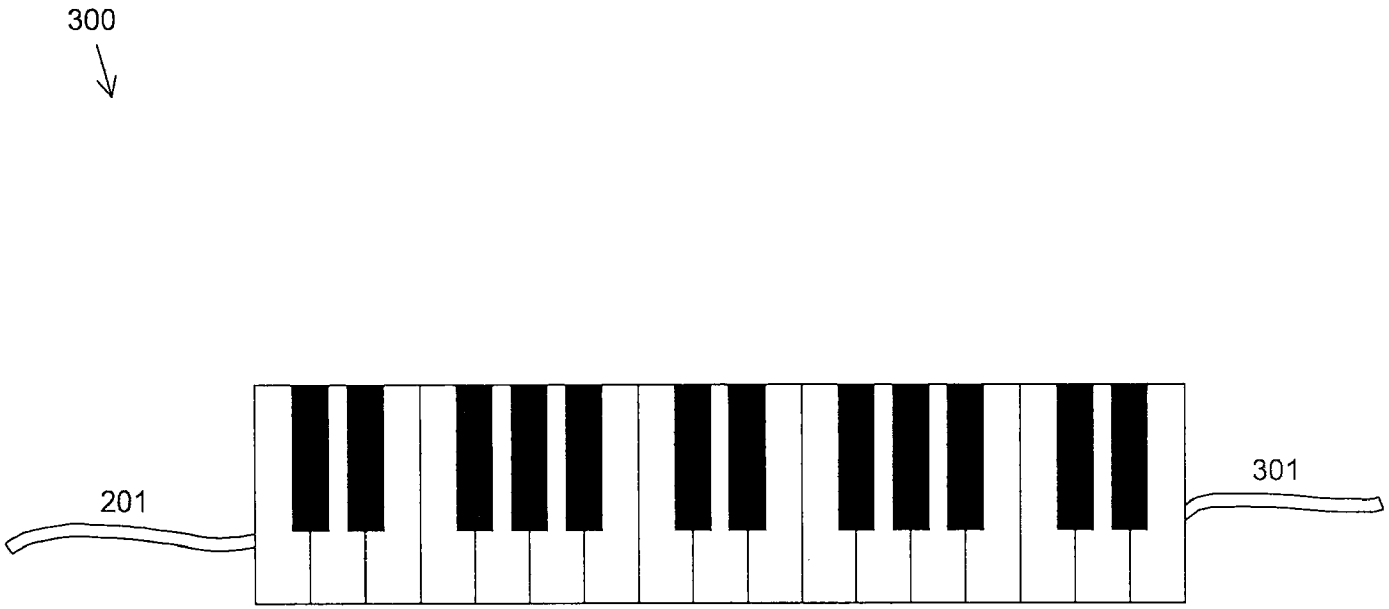
FIG. 4 illustrates a musical instrument digital interface device used in accordance with an embodiment described herein.

Referring to FIG. 1, in some embodiments, music performance system 1 comprises music worksheet 100, computer 200, Musical Instrument Digital Interface (MIDI) device 300, sequencer 400, sending unit 500 and at least one receiving unit 600. MIDI device 300 receives MIDI output signal 310 from computer 200 and produces a coded digital signal 320. Coded digital signal 320 is further processed by sequencer 400 to produce corresponding signal 440, which is transmitted through space by sending unit 500 via signals 510, 512, 514, 516 (for example) to reach receiving units 600.

In the preferred embodiment, sixteen choir members are used in the system. Thus, at least sixteen receiving units are required (at least one per member). In addition, quartets (four members) and octets (eight members) are possible. The system even provides the potential to assemble as many as a hundred members or more, or as few as one member.

Music worksheet 100, as illustrated in FIG. 2, is a unique musical graph design that functions as a transposing tool and tempo control tool for music. Music worksheet 100 is the initial tool used to design a signal pattern that can be sent out as wireless signals to coordinate the rhythm and timing associated with the playing of a particular musical selection. It should be appreciated that a musical worksheet is personal to each respective piece of music being performed by the choir or group. The musical worksheets are translated into a signal pattern using one of two modes: automatic mode or manual mode. Music worksheet 100 illustrates the coordination of the music using the placement of musical notes (represented by "x") relative to their order, timing, rhythm and instrumentation required to perform the musical piece. Color codes may also be used in the worksheet to represent specific sounds or instruments. For example, different colors can represent bell chimes or regular handbells, trumpet sounds, saxophone sounds, violin sounds, flute sounds, etc.

Preferably, music worksheet 100 uses a tempo-based system to control melodies and chords played. As used in the preferred embodiment, column A has 16 musical notes that represent the note locations on a 16-note MIDI device (described below). Column B has numbers 1 though 16 that represent the sixteen members of the choir who play the predetermined musical notes (assuming each member is playing one musical note). Column C is made up of predetermined musical notes (or tones and sounds). The bottom and top rows of music worksheet 100 have numbers 1 through 41 which represent the timing beats. Each column with an "x" represents the members who play their instrument on that beat.

As noted above, music performance system 1 can operate in either manual mode or automatic mode. In automatic mode, music worksheet 100 is input into a music software program or computer readable storage medium 210 that is executed by a computer such as computer 200, and stored as a data file. In the preferred embodiment, musical writing software called Cakewalk is used. Alternatively, there are other music software programs 210 that can create music worksheet 100 based on previously stored musical pieces or inputted musical pieces. The musical pieces can be inputted using any known method in the art. Music performance system 1 is compatible with all known methods. Once music worksheet 100 has been inputted, the musical piece is ready to perform. Computer 200 can be comprised of a microprocessor, a custom-designed and dedicated microcontroller, or a personal computer (PC) that can be operated by one of many MIDI software programs 210 that are readily available and known by one of ordinary skill in the art. It should also be appreciated that computer 200 may be a desktop computer, laptop computer, personal digital assistant, Smartphone, or any other suitable device known in the art.

In the automatic mode, any director (with or without previous music experience) can lead the members' performance by the pressing of one button. When the one button is pushed, the data file consisting of music worksheet 100 is transferred from computer 200 into MIDI device 300, e.g., a MIDI keyboard or a MIDI interface card. Universal serial bus (USB) cord 201 provides the connection between computer 200 and MIDI device 300. MIDI device 300, once it receives music worksheet 100, automatically drives the entire music performance system 1. MIDI device 300 is programmed to only allow the electrical signals corresponding to selected notes of a musical score to be processed and subsequently transmitted by the sending unit 500 (described below). In another embodiment, instead of using computer 200, previously written or previously created music worksheets for desired songs can be downloaded from various websites, and directly loaded into MIDI device 300, dependent on the capabilities of the respective device. It should also be appreciated that previously written or previously created music worksheets can be downloaded into computer 200.

The term MIDI is an acronym for Musical Instrument Digital Interface. MIDI provides a standard protocol for communication between different electronic devices, such as between computer 200 and MIDI device 300. MIDI is an industry-standard protocol that enables electronic musical instruments such as keyboard controllers, computers, and other electronic equipment to communicate, control, and synchronize with each other (i.e., exchange system data). MIDI does not transmit an audio signal or media—it transmits "event messages" such as the pitch and intensity of musical notes to play, control signals for parameters such as volume, vibrator and panning, cues, and clock signals to set the tempo. A MIDI keyboard, for example, is a piano-style digital keyboard device used for sending MIDI signals or commands to other devices connected to the same interface as the keyboard. The basic MIDI keyboard does not produce sound. Instead, MIDI information is sent to an electronic module capable of reproducing an array of digital sounds or samples that resemble traditional analog musical instruments.

MIDI device 300, which can also be designed as a MIDI interface card that is used as a component of sequencer 400 or computer 200, receives the MIDI output signal 310 and produces a corresponding coded digital signal 320 (as seen in FIG. 1) that is further processed by sequencer 400 (described below). The MIDI formatted data travels via MIDI cord 301 to sequencer 400. Sequencer 400 decodes the coded digital signal 320 received from MIDI device 300 and produces a note signal 440. Each musical note is assigned a unique digital code by the MIDI software program 210. The software program 210 is programmed to only allow the musical notes applicable to a specific musical score, corresponding to music worksheet 100, that are to be played by a bell ringer to be activated and transmitted.

In manual mode, music worksheet 100 is visually read by the director or a member, and traditionally played into MIDI device 300, e.g., played on a MIDI keyboard. For example, it is similar to a pianist reading a piano score and playing the piano. Music worksheet 100 is read as a music score and played, by a person who is proficient in piano, piano keyboard or other instrument, on the MIDI keyboard or other similar MIDI device. Similar to the embodiments described above, music performance system 1 receives each note manually played on device 300 and processes it to produce the corresponding coded digital signal 320. These steps can occur simultaneously. While in manual mode, music performance system 1 does not need or require computer 200. Thus, there are embodiments described herein that do not include computer 200. It should be understood that MIDI device 300 is not necessarily a keyboard, but may be any MIDI device known in the art that can create useable data for sequencer 400.

Figure 5:
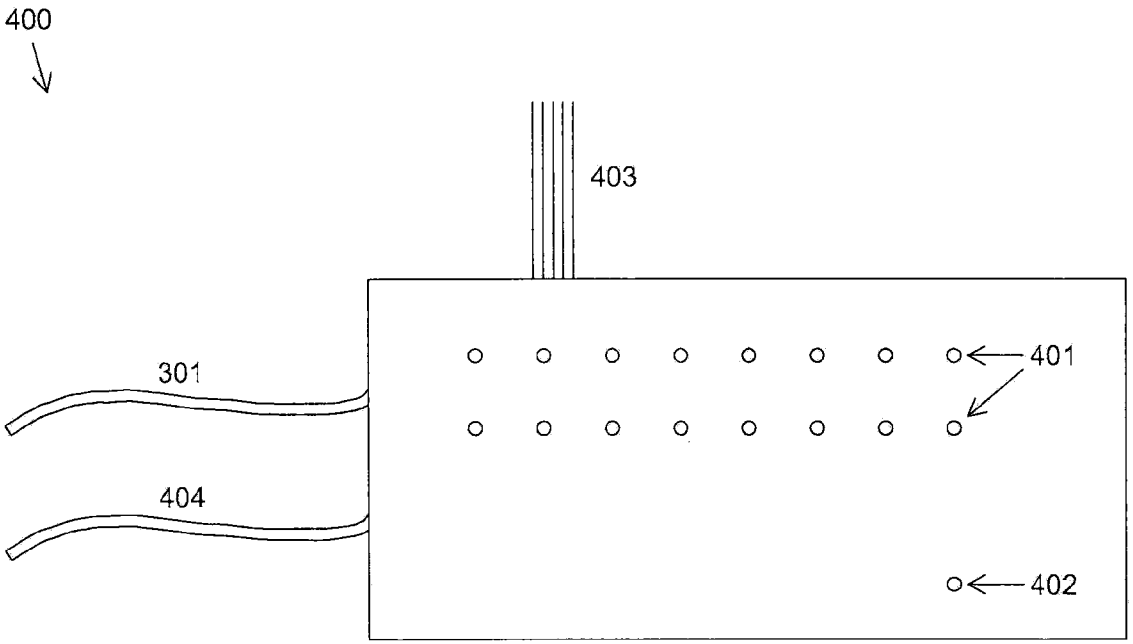
FIG. 5 illustrates a sequencer used in accordance with an embodiment described herein.

Once MIDI device 300 transitions data from a MIDI formatted music worksheet 100 into a format suitable for sequencer 400 (i.e., a coded digital signal), coded digital signal 320 is sent to sequencer 400, as shown in FIG. 5. Sequencer 400 receives the order, timing, and location of the electronic pulses included in the coded digital signal 320, decodes them, and forms individual note signals 440 or destinations corresponding to each musical note to send to sending unit 500. Sequencer 400 also creates the common ground for sending unit 500 and operates via power cord 404. In the preferred embodiment, sixteen destinations are available for pulses to be directed. Those destinations are represented by sixteen nodes 401 in sequencer 400. These pulses trigger wireless signals which are emitted from sending unit 500. A member or director may set the tempo of the performance by adjusting the transmission rate (i.e., beat) of the signals according to sequencer 400. For example, if the default setting of sequencer 400 is 120 beats per minute, a member may make the tempo faster or slower by adjusting the beats per minute dictated by sequencer 400. Sending unit 500 operates with a set frequency and has means for receiving the note signal 440 and modulating the signal onto the carrier frequency of each respective receiving unit. The output of sequencer 400 is a corresponding signal 440 that is applied into space by the sending unit 500.

Figure 6:
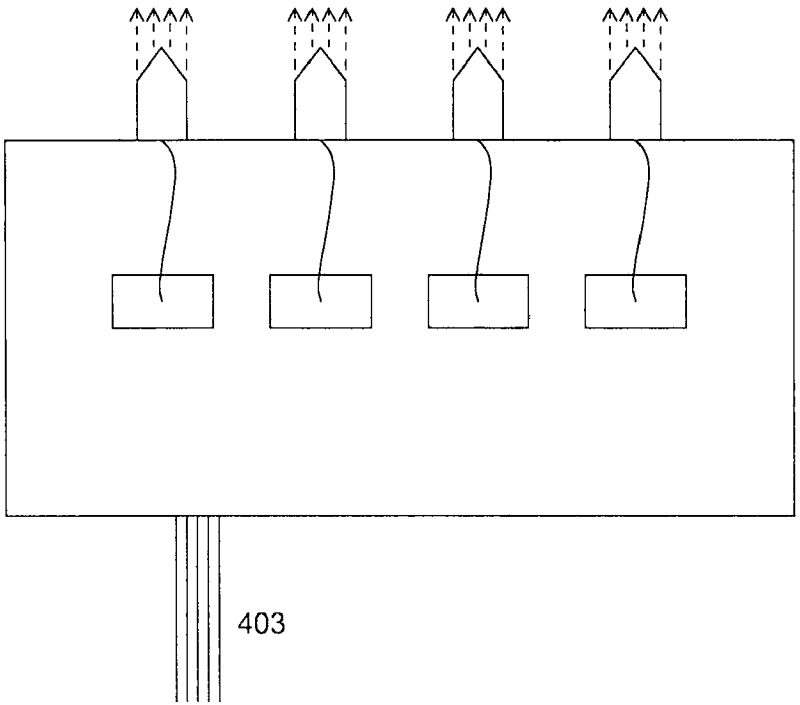
FIG. 6 illustrates a sending unit used in accordance with an embodiment described herein.

FIG. 6 illustrates sending unit 500, which is connected to sequencer 400 via computer ribbon 403. Sending unit 500 receives signal 440 and sends out signals to receiving units 600. Sending unit 500 and receiving units 600 can be connected wirelessly. It should also be appreciated that sending unit 500 can also be combined into sequencer 400. It is important to note that sending unit 500 transmits each individual signal corresponding to each individual musical note and only serves as a transmitting mechanism. No signal processing is being done by sending unit 500.

Figure 7:
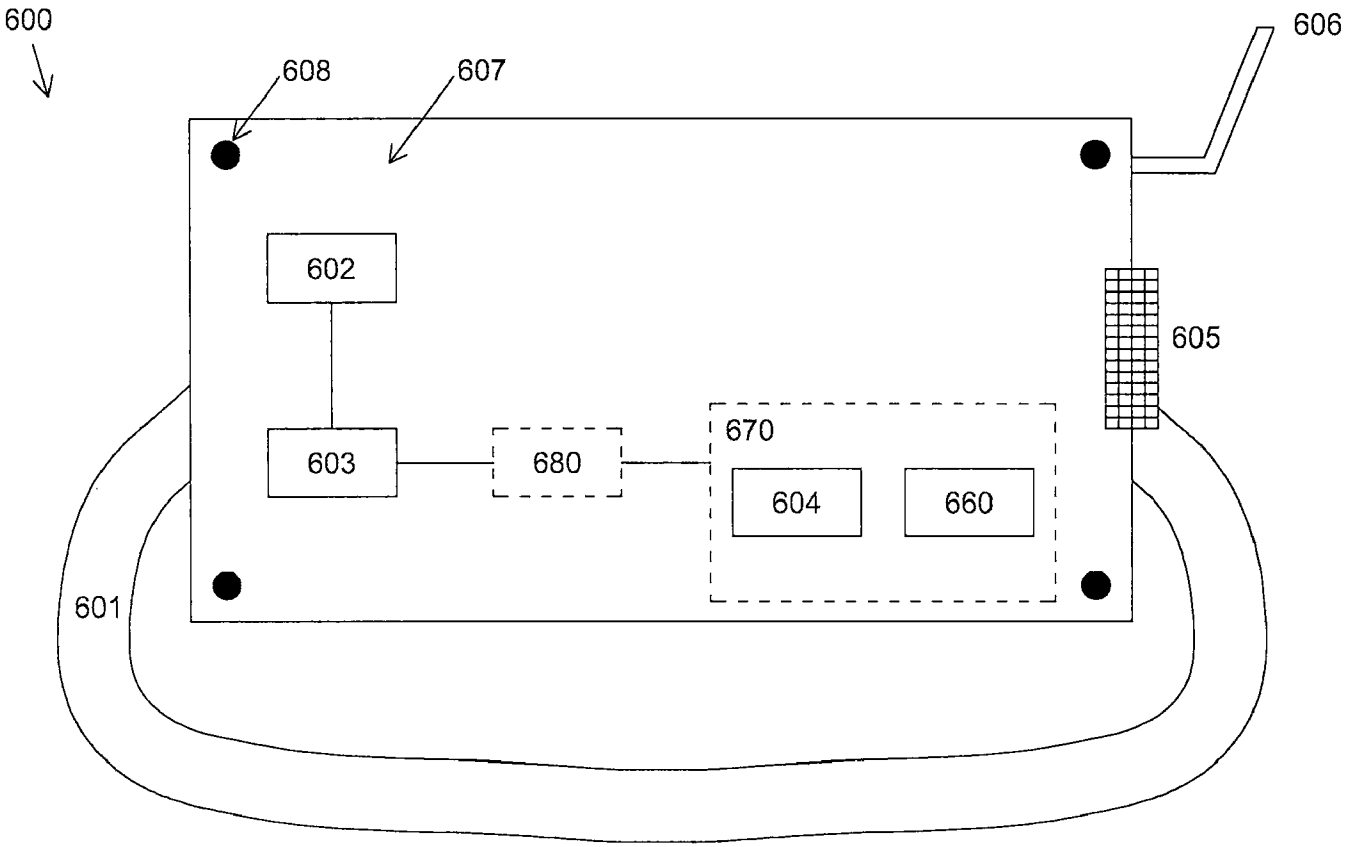
FIG. 7 illustrates a single receiving unit used in accordance with an embodiment described herein.

FIG. 7 illustrates a single receiving unit 600. Receiving unit 600 can be temporarily strapped to specific members using Velcro straps 601. When ready for performance, members can attach Velcro strap 601 of the receiving unit 600 to one arm while holding an instrument (e.g., handbell sound producer) in the same hand. The same procedure is used with the member's other arm if the member is playing more than one instrument. This enables the member to play an instrument which corresponds to the signal of its corresponding receiving unit 600. When the receiving unit 600 receives a signal (e.g., 510) from sending unit 500 via antenna 606, in the preferred embodiment, wireless receiver component 603 causes vibrator 604 to vibrate. The signal from sending unit 500 triggers the vibration for the duration of the signal. The signal duration corresponds to the musical note value of the music to be performed. Vibrator 604 acts similar to a vibrator in a cellular telephone. The vibration prompts the member to move their arm forward (just as ringing a bell). When the member moves their arm forward, the instrument (e.g., handbell) rings out the desired instrument sound (from digitally reproduced sounds stored in the bell). When single wireless signals are received and rang out, a melody is heard. When several signals are received simultaneously and rang out, musical chords are heard. A combination of the two creates a musical performance.

Figure 8A:
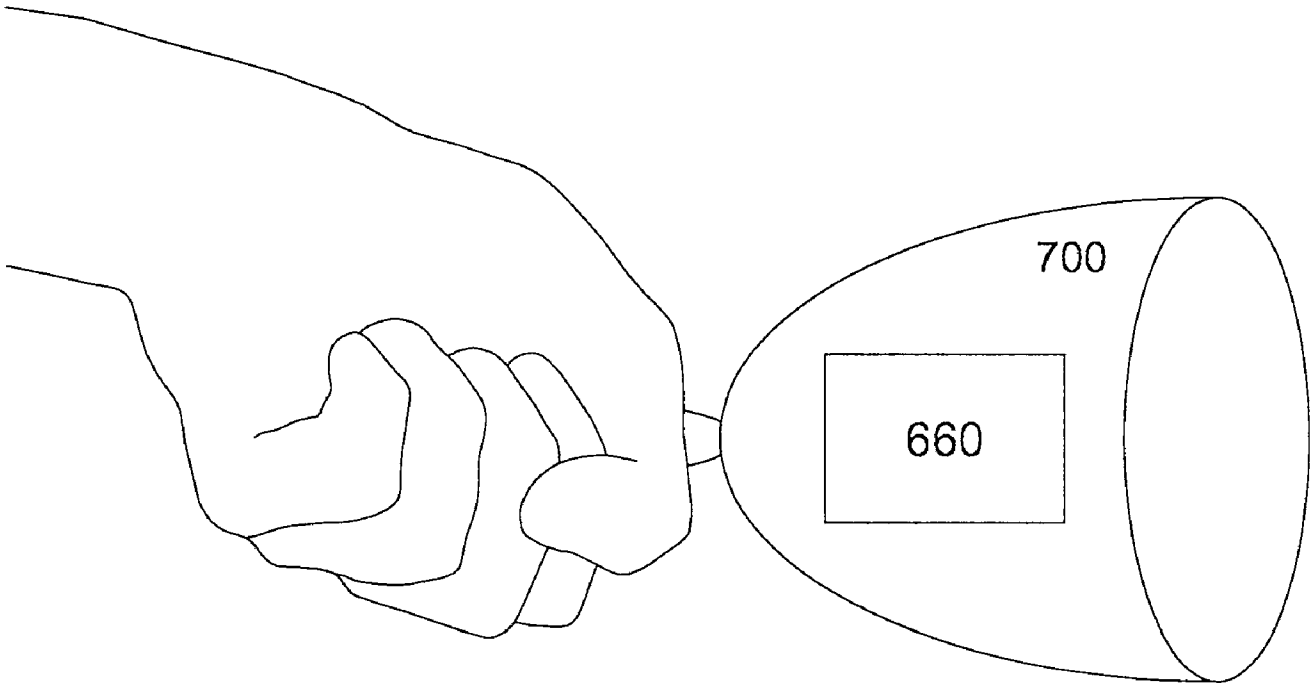
FIGS. 8A-8C illustrate variations on the receiving unit used in accordance with embodiments described herein.
Figure 8B:
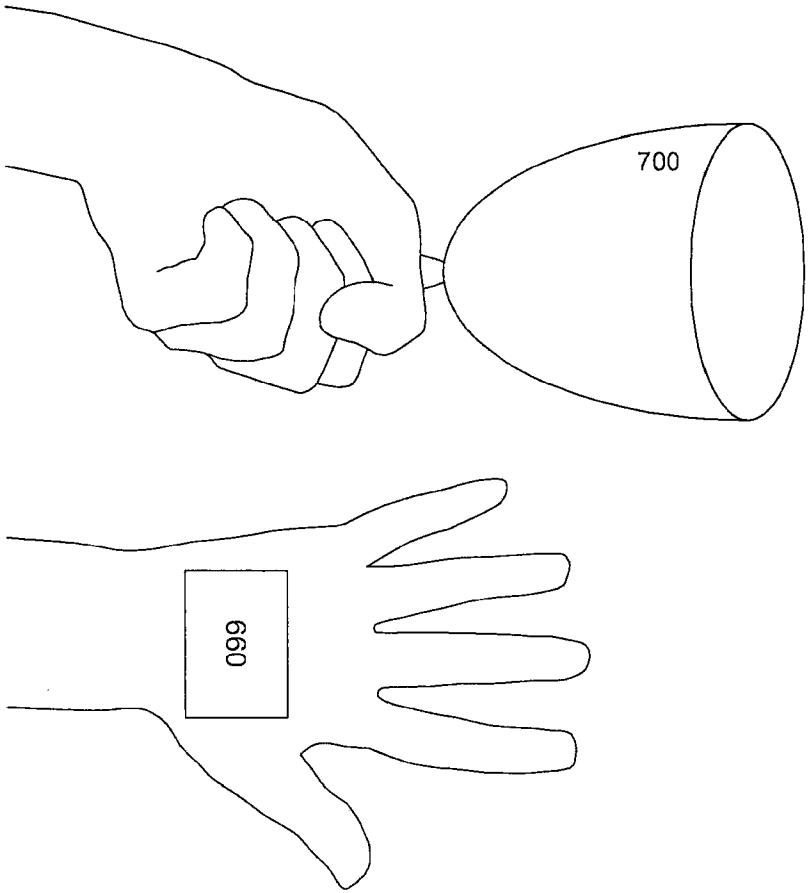
Figure 8C:
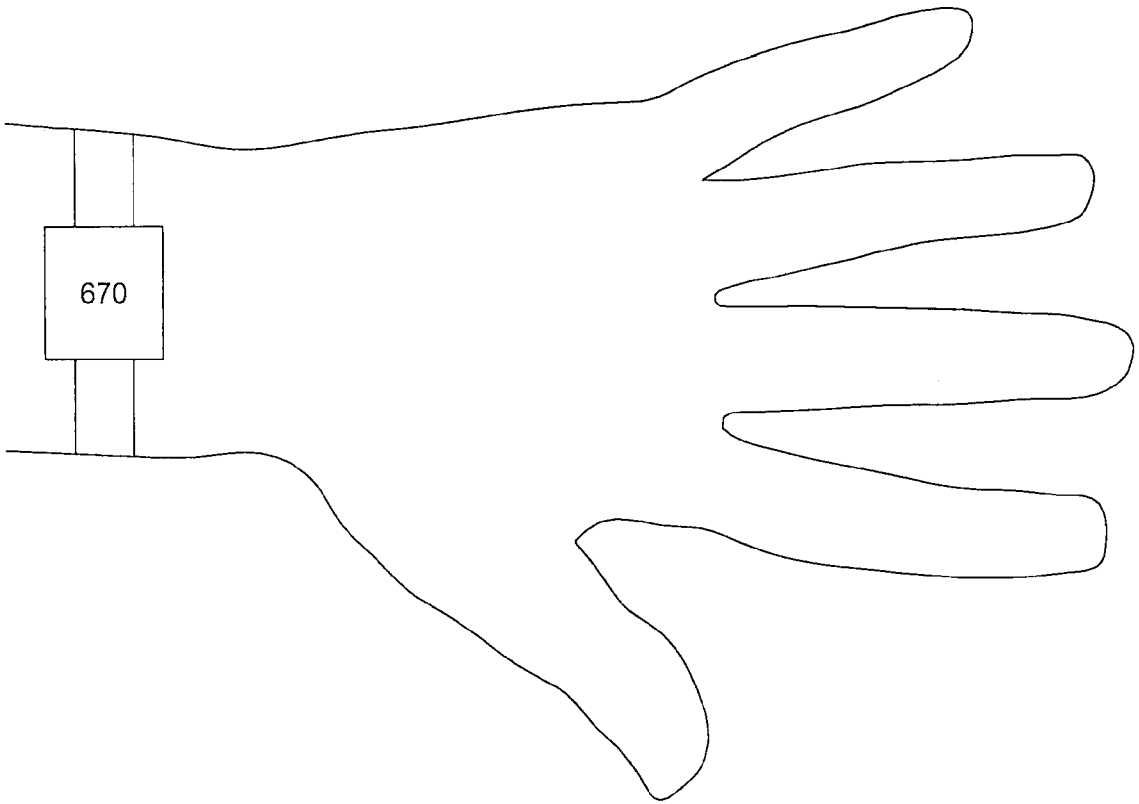

Receiving unit 600 comprises: receiver component 603, decoder 680, and signaling device 670, which consists of LED display 660 and/or vibrator 604. The signaling device 670 signals a bell ringer when to ring or stop ringing the bell 700 (described below). The LED display 660 can be attached directly to the hand-held bell 700, as shown in FIG. 8A, or the LED display 660 can be held by the hand that is not holding the bell 700, as shown in FIG. 8B. The vibrator 604 can be attached to a body part such as a wrist, as shown in FIG. 8C. There can be a total of eighty-eight signaling devices 670, (corresponding to the maximum eighty-eight keys of an electronic keyboard), that are tuned to the specific frequency of the transmitted signal (e.g., 510). All of the eighty-eight receiving circuits are set to recognize a specific musical note.

The transmitted signal (e.g., 510) produced by the sending unit 500 is received by receiving unit 600. The receiving unit 600 is a fixed-frequency receiver that is tuned to the transmitted frequency of the corresponding sending unit 500.

When the receiving unit recognizes the note signal, it produces a vibrator enabling signal or an LED enabling signal. The vibrator is typically of the type used in cell phones or pagers, and is known in the industry as a "silent ringer." When either the vibrator or the LED display is active, the bell choir member rings their specific bell 700. When the vibrator or the LED display is no longer active, the choir member stops ringing their bell 700.

In the event that two or more notes are simultaneously to be played, a serial signal (not shown) that corresponds to all notes will be passed. As each note is no longer needed, that code will no longer be transmitted, thus deactivating vibrator 604 and/or LED display 660.

Receiving unit 600 can be battery operated by battery 302 and can be built into a small package about half the size of a standard "pager." It can also be built into a device small enough to be worn like a wrist watch, but the circuitry may need to be custom made to fit a package that size. As previously mentioned, the number of receiving units must correspond to the number of notes desired. Each enclosure of the receiving units is preferably marked with the musical note that the circuit is designed to recognize. Receiving unit 600 can vibrate or make any other tactile, visual, or audible signal. Receiving unit 600 may have an on/off switch 605 that is a double pull double throw switch. All components are hot glued into a plastic 5"×3" casing 607. The casing lid is held in place by four ½" screws 608.

Receiving unit 600 can be musical tone producers that receive the wireless music signals and enable users to perform an unlimited number of songs and musical pieces. Receiving unit 600 can utilize digitally reproduced sounds of musical instruments to provide the desired instrumentation to songs performed. For example, a traditional bell choir with traditional bell sounds can become a bell choir with trumpet sounds, saxophone sounds, guitar sounds, and French horn sounds, among others. Music performance system 1 creates string quartets, trumpet trios, and many more combinations of instruments and sounds. Receiving unit 600 enables members to perform musical pieces without requiring previous musical training or ability.

Figure 9:
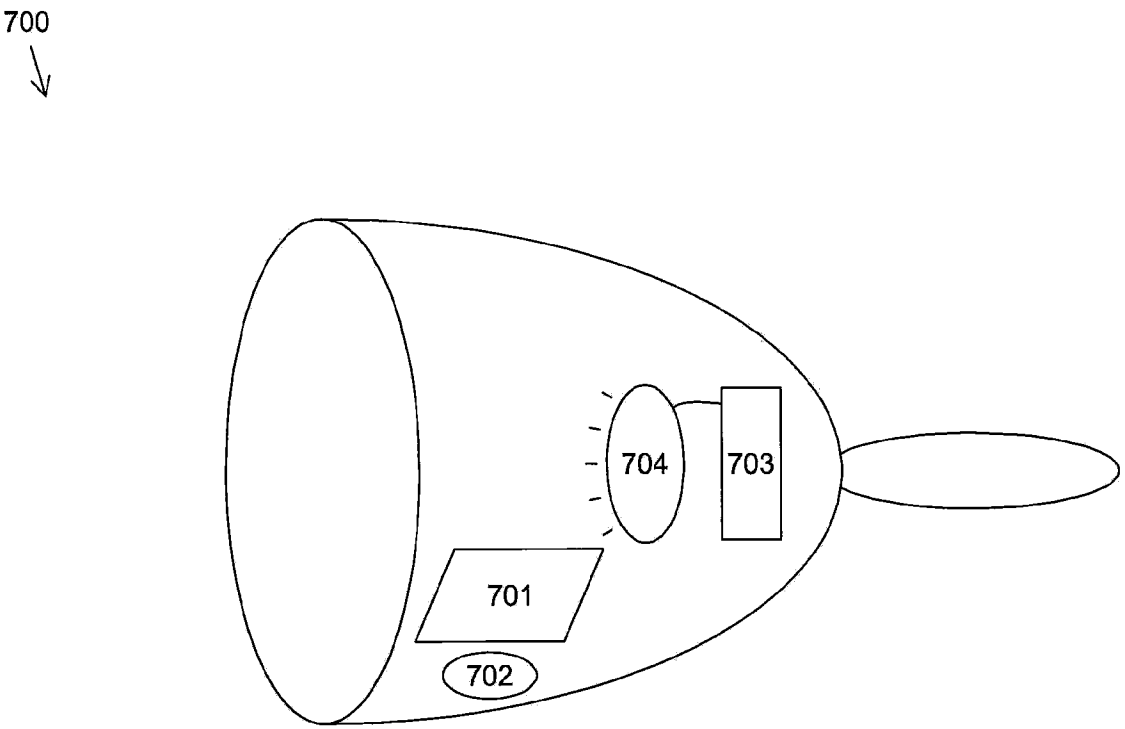
FIG. 9 illustrates a handbell sound producer used in accordance with an embodiment described herein.

FIG. 9 illustrates an exemplary handbell sound producer 700, e.g., a handbell that emits digitally reproduced sounds of musical instruments by making a downward swing with the arm (similar to ringing a traditional bell). This downward motion forces the knife-switch lever 701 into a downward position which completes the circuit with the battery 702 and the digital sound playback device 703. The sound is played through the attached speaker 704. Numerous sounds are stored in the digital playback and can be selected prior to ringing the digital bell. The handbell sound producer 700 provides the bell choir with a full orchestra of sounds ranging from violins to trumpets and trombones. A full concert orchestra of handbells is made possible by this device. The handbell sound producer 700 can be used instead of a traditional instrument, for example, a traditional handbell.

Music performance system 1 creates accessibility to the musical performance experience for all populations who can benefit from the experience. The system is a wireless system that is user-friendly to the average consumer regardless of abilities or disabilities. It is as user-friendly as using a cell phone. The system eliminates timely rehearsals and musical talent prerequisites. By using wireless technology, the system simply coordinates each member's instrument (e.g., a handbell) to the proper order and timing needed to make melodies, chords, and music. The members receive a signal that tells them the right order and right timing to play their instrument. The signal not only tells one when to play their instrument, but it may also allow one to select the sound the instrument will make. In contrast, the traditional handbell in a bell choir, for example, makes only one sound and the order and timing requires one or more of the following: vision, hearing, music reading ability, memorizing ability, or musical ability. The system is a new way of reading, writing, and playing music. It makes music performance accessible to persons with disabilities, Alzheimer's disease, or any school-aged youth. It is especially useful with persons who are visually impaired.

The above description and drawings are only to be considered illustrative of specific embodiments, which achieve the features and advantages described herein. Modifications and substitutions to specific process conditions can be made. Accordingly, the embodiments of the invention are not considered as being limited by the foregoing description and drawings, but is only limited by the scope of the appended claims.

What is claimed as new and desired to be protected by Letters Patent of the United States is:

1. A system for performing in concert, comprising:

a program stored on a non-transitory computer readable medium configured to receive a music worksheet, the music worksheet comprising musical note information on order, timing, rhythm, and instrumentation;

a musical instrument digital interface unit for receiving the music worksheet and producing coded digital signals corresponding to the musical note information;

a sequencer for receiving the coded digital signals including at least an order, a timing and a location, decoding the coded digital signals, and forming electronic pulses corresponding to the order, the timing and the location based on the decoded digital signals such that each electronic pulse corresponds to a unique musical note;

a sending unit for transmitting the electronic pulses as note signals to members of a choir, wherein the transmitted electronic pulses trigger wireless signals; and at least one receiving unit, being associated with at least one member of the choir, for receiving the wireless signals and causing the receiving unit to alert the member of the choir to play a musical instrument.

2. The system of claim 1, wherein the musical instrument digital interface unit is a MIDI keyboard.

3. The system of claim 1, wherein the at least one receiving unit is a cellular telephone.

4. The system of claim 1, wherein the at least one receiving unit further comprises an antenna and a vibrator.

5. The system of claim 1, wherein the musical instrument digital interface unit, sequencer, and sending unit are comprised in a single device.

6. The system of claim 1, wherein the at least one receiving unit is worn by the member of the choir on their wrist.

7. The system of claim 1, wherein the alert is an audible signal.

8. The system of claim 1, wherein the alert is a visual signal.

9. The system of claim 1, wherein the system comprises a plurality of receiving units, each receiving unit corresponding to a different musical note.

10. The system of claim 1, wherein the at least one receiving unit further comprises a LED display.

11. The system of claim 10, wherein the LED display is attached directly to a hand-held bell.

12. The system of claim 11, wherein the hand-held bell makes sounds of various musical instruments.

13. A system for performing in concert, comprising:

a program stored on a non-transitory computer readable medium configured to receive a performance worksheet, the performance worksheet comprising musical note information on order, timing, rhythm, and instrumentation;

a musical instrument digital interface unit for receiving the performance worksheet and producing a first signal corresponding to musical note information;

a sequencer for receiving the first signal, decoding the first signal to form a second signal including at least an order, a timing and a location, and forming a third signal corresponding to the order, the timing and the location based on the second signal such that the third signal corresponds to a unique movement;

a sending unit for emitting the third signal as a fourth wireless signal; and at least one receiving unit, being associated with a member of a group, for receiving the fourth wireless signal and causing the receiving unit to alert the member to make a motion.

14. The system of claim 13, wherein the sending unit is wirelessly connected to the at least one receiving unit.

15. The system of claim 13, wherein the at least one receiving unit comprises:

a strap; a battery; an antenna; a wireless receiver; a decoder; and a signaling device.

16. The system of claim 15, wherein the wireless receiver is connected to the decoder and the signaling device.

17. The system of claim 16, wherein the signaling device comprises a vibrator or a LED display.

18. The system of claim 16, wherein the at least one receiving unit produces a tactile signal.

19. The system of claim 16, wherein the at least one receiving unit produces an audible signal.

20. The system of claim 16, wherein the at least one receiving unit produces a visual signal.

21. The system of claim 15, wherein the strap is fastened by Velcro.

22. The system of claim 13, wherein the musical instrument digital interface unit is a MIDI keyboard.

* * * * *